US010183186B2

(12) United States Patent
Phillips

(10) Patent No.: US 10,183,186 B2
(45) Date of Patent: Jan. 22, 2019

(54) FIRE SUPPRESSION SYSTEMS AND METHODS

(71) Applicant: Ryan Thomas Phillips, Bend, OR (US)

(72) Inventor: Ryan Thomas Phillips, Bend, OR (US)

( * ) Notice: Subject to any disclaimer, the term of this patent is extended or adjusted under 35 U.S.C. 154(b) by 153 days.

(21) Appl. No.: 15/059,717

(22) Filed: Mar. 3, 2016

(65) Prior Publication Data

US 2016/0256719 A1 Sep. 8, 2016

Related U.S. Application Data

(60) Provisional application No. 62/127,384, filed on Mar. 3, 2015.

(51) Int. Cl.
*A62C 35/02* (2006.01)
*A62C 37/11* (2006.01)

(52) U.S. Cl.
CPC ..... *A62C 37/11* (2013.01); *A62C 35/02* (2013.01)

(58) Field of Classification Search
CPC ..... A62C 37/11; A62C 37/12; A62C 37/14; A62C 35/02; A62C 35/13; A62C 2/04; F16K 1/38
USPC ..... 169/46, 5, 11, 26, 19
See application file for complete search history.

(56) References Cited

U.S. PATENT DOCUMENTS 1,507,745 A 9/1924 MacGregor et al.
2,190,229 A 2/1940 Bradley
3,779,179 A 12/1973 Marois
3,893,514 A 7/1975 Carhart et al.
4,726,426 A 2/1988 Miller
4,986,366 A 1/1991 O'Connell
5,505,266 A 4/1996 Fujiki
5,551,517 A * 9/1996 Arsenault ..... A62C 37/12 169/26
6,019,115 A * 2/2000 Sanders ..... F16K 17/30 137/10
6,568,336 B2 5/2003 Van Lint
6,935,433 B2 8/2005 Gupta
7,434,628 B2 10/2008 Scheidt
8,256,525 B2 9/2012 Wagner
8,607,888 B2 12/2013 Nusbaum
2008/0078563 A1 * 4/2008 Hock ..... A62C 99/0018 169/49

* cited by examiner

*Primary Examiner* — Darren W Gorman
*Assistant Examiner* — Juan C Barrera
(74) *Attorney, Agent, or Firm* — Chernoff Vilhauer LLP

(57) ABSTRACT

Fire suppression systems and methods of suppressing fires are disclosed. A fire suppression system may include a housing including inlet and outlet ports, and a housing interior having a fluid passage sized to contain a fire suppressing fluid source between the inlet and outlet ports. The inlet and outlet ports may be fluidly connected to the fluid passage. The system may additionally include a fluid discharge assembly configured to discharge fire suppressing fluid from a flow control assembly into the fluid passage and toward the outlet port. At least one of the fluid passage and the fluid discharge assembly may be configured such that the discharge of the fire suppressing fluid into the fluid passage draws air into the fluid passage through the inlet port and around the fire suppressing fluid source, and expels air and the fire suppressing fluid out of the fluid passage and through the outlet port.

10 Claims, 12 Drawing Sheets

FIRE SUPPRESSION SYSTEMS AND METHODS

CROSS-REFERENCE TO RELATED APPLICATIONS

This application claims the benefit of U.S. Provisional Patent Application Ser. No. 62/127,384, which was filed on Mar. 3, 2015 and entitled "Fire Suppression Systems." The complete disclosure of the above application is hereby incorporated by reference for all purposes.

FIELD OF THE DISCLOSURE

The present disclosure relates generally to fire suppression systems. More specifically, the disclosed embodiments relate to systems and methods for absorbing heat from an enclosure and reducing the concentration of oxygen within the enclosure.

BACKGROUND OF THE DISCLOSURE

Enclosures, such as safes, cabinets, and other enclosed spaces, may be used to contain valuable items and/or equipment. Examples of valuable items may include documents, money, stock certificates, jewelry, etc. Examples of equipment that may be contained in an enclosure include control equipment, computer devices, electronic equipment, etc. An enclosure may be protected using fire-rated insulation to slow the heating of the interior of that enclosure. However, once the heating exceeds the fire rating, the contents of the enclosure are no longer protected by the fire-rated insulation.

Alternatively, or additionally, a fire suppression system may be used to protect the enclosures and their contents. Examples of fire suppression systems, including fire suppression systems for enclosures and other enclosed spaces, are disclosed in U.S. Pat. Nos. 1,507,745; 2,190,229; 3,779,179; 3,893,514; 4,726,426; 4,986,366; 5,505,266; 6,568,336; 6,935,433; 7,434,628; 8,256,525; and 8,607,888. The complete disclosures of the above patents are hereby incorporated by reference for all purposes.

Many of the existing fire suppression systems use water as a fire suppressant, which require a source of water, and may expose documents or electronics to undesired amounts of water. Other existing fire suppression systems use non-combustible fluids such as carbon dioxide to displace the oxygen a fire requires, but do nothing to remove heat from an enclosure or otherwise lower the temperature within the enclosure.

SUMMARY OF THE DISCLOSURE

A fire suppression system may include a housing including an inlet port, an outlet port, and a housing interior having a fluid passage. The fluid passage may be sized to contain a fire suppressing fluid source between the inlet and outlet ports and the inlet and outlet ports may be fluidly connected to the fluid passage. The system may include a temperature sensor assembly configured to detect an increase in temperature corresponding to presence of a fire and a flow activation assembly including a connector configured to be coupled to the fire suppressing fluid source. The system may include a flow control assembly, wherein the flow activation assembly is configured to fluidly connect the fire suppressing fluid source with the flow control assembly in response to a detected increase in temperature by the temperature sensor assembly. The flow control assembly may be configured to maintain a constant flow of fire suppressing fluid when the flow activation assembly fluidly connects the fire suppressing fluid source with the flow control assembly. The system may include a fluid discharge assembly configured to discharge the fire suppressing fluid from the flow control assembly into the fluid passage and toward the outlet port. At least one of the fluid passage and the fluid discharge assembly may be configured such that the discharge of the fire suppressing fluid into the fluid passage draws air into the fluid passage through the inlet port and around the fire suppressing fluid source, and expels air and the fire suppressing fluid out of the fluid passage and through the outlet port.

A fire suppression system may include a sensor assembly having a temperature-sensitive release mechanism, an activation assembly configured to discharge fire suppressing fluid from a fire suppressing fluid source, and a flow control assembly configured to maintain a constant discharge flow of the fire suppressing fluid. The activation assembly may include a connector configured to be coupled to a fire suppressing fluid source and a barrier configured to separate fire suppressing fluid of the fire suppressing fluid source from the flow control assembly. The activation assembly may include a puncturing device configured to move between a proximal position, in which the puncturing device is spaced from the barrier, and a distal position, in which the puncturing device punctures and extends through the barrier, and a first spring configured to urge the puncturing device toward the distal position. The activation assembly may further include a locking member configured to move between a locking position in which the puncturing device is secured in the proximal position against the urging of the first spring, and an unlocking position in which the puncturing device is released from the proximal position allowing the first spring to urge the puncturing device toward the distal position. The activation assembly may include an interlock pin configured to move between a retracted position, in which the locking member is secured in the locking position, and an extended position, in which the locking member is allowed to move to the unlocking position, and a second spring configured to urge the interlock pin toward the extended position. The temperature-sensitive release mechanism may be configured to secure the interlock pin in the retracted position against the urging of the second spring, and to release the interlock pin and allow the second spring to urge the interlock pin toward the extended position when the temperature-sensitive release mechanism is exposed to a predetermined first temperature that corresponds to presence of a fire.

A method of suppressing a fire may include detecting an increase in temperature that corresponds to presence of a fire. The method may further include discharging fire suppressing fluid from at least one fire suppressing fluid source into a fluid passage and toward an outlet of the fluid passage in response to a detected increase in temperature. The fluid passage may be sized to contain the at least one fire suppressing fluid source. Discharging the fire suppressing fluid may draw air from the enclosure into the fluid passage through an inlet of the fluid passage and around the at least one fire suppressing fluid source, and expel air and the fire suppressing fluid out of the fluid passage through the outlet and toward the enclosure.

The present disclosure proves various systems and apparatuses and methods of use thereof. In some embodiments, a system may include a fluid discharge assembly configured to discharge fire suppressing fluid into an enclosure. In some embodiments, discharging fire suppressing fluid into an enclosure may drive circulation of air through a heat exchanger configured to cool the air and return the cool air to the enclosure. In some embodiments, the discharge of fire suppressing fluid into an enclosure may be triggered mechanically by a detected increase in temperature corresponding to the presence of a fire. In some embodiments, a constant discharge of fire suppressing fluid may be maintained as the fire suppressing fluid source is depleted.

Features, functions, and advantages may be achieved independently in various embodiments of the present disclosure, or may be combined in yet other embodiments, further details of which can be seen with reference to the following description and drawings.

DESCRIPTION

Overview

Various embodiments of a fire suppression system having an activation assembly and a fire-suppressing fluid flow control assembly are described below and illustrated in the associated drawings. Unless otherwise specified, the fire suppression system and/or its various components may contain at least one of the structure, components, functionality, and/or variations described, illustrated, and/or incorporated herein. Furthermore, the structures, components, functionalities, and/or variations described, illustrated, and/or incorporated herein in connection with the present teachings may be included in other similar apparatuses. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

EXAMPLES, COMPONENTS, AND ALTERNATIVES

The following sections describe selected aspects of exemplary fire suppression systems and apparatuses as well as related methods. The examples in these sections are intended for illustration and should not be interpreted as limiting the entire scope of the present disclosure. Each section may include one or more distinct inventions, and/or contextual or related information, function, and/or structure.

Example 1

Figure 1:
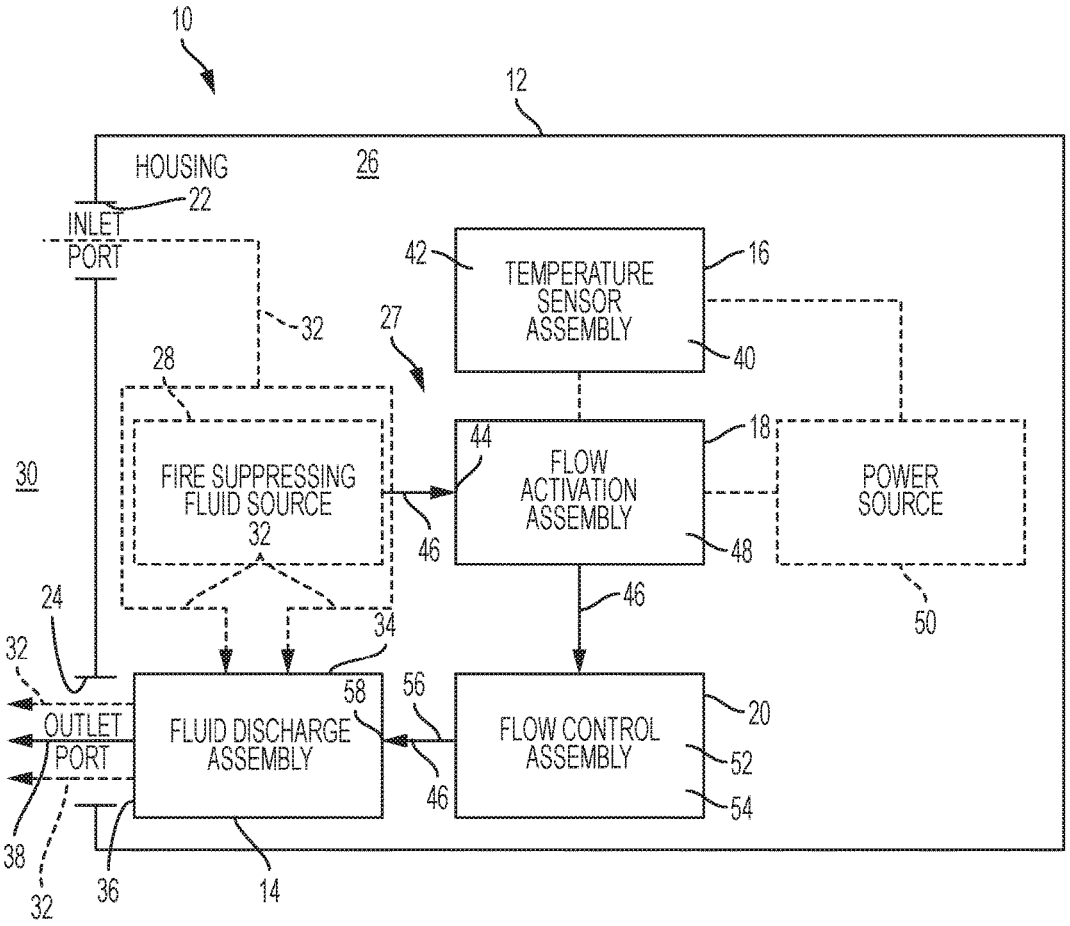
FIG. 1 is a block diagram of an illustrative fire suppression system.

This example describes an illustrative fire suppression system, see FIG. 1.

FIG. 1 is a block diagram of an illustrative fire suppression system, generally indicated at 10. Fire suppression system 10 may include any suitable structure configured to suppress fires, such as fires within an enclosure. For example, fire suppression system 10 may include a housing 12, a fluid discharge assembly 14, a temperature sensor assembly 16, a flow activation assembly 18, and a flow control assembly 20.

Housing 12 may include any suitable structure configured to contain one or more other components of the fire suppression system. For example, the housing 12 may include an inlet port 22 and an outlet port 24, as well as other ports or openings. The housing 12 may define a housing interior or interior space 26. The inlet and outlet ports 22 and 24 may be fluidly connected to the housing interior 26 and may connect the housing interior to a space external to the housing. The housing interior may include a fluid passage 27 sized or configured to contain a fire suppressing fluid source 28 between the inlet and outlet ports. The inlet and outlet ports may be fluidly connected to the fluid passage. The housing may be made of any suitable materials, such as one or more metals and/or polymer materials.

The housing 12 may be disposed within or adjacent to an enclosure 30, such as a safe or a cabinet. The fire suppression system 10 may be configured to prevent a fire from igniting within the enclosure 30, to prevent a fire from entering the enclosure from outside of the enclosure, or to suppress or otherwise put out a fire burning within the enclosure.

Fluid discharge assembly 14 may include any suitable structure configured to circulate air within housing 12. For example, the fluid discharge assembly may draw air into the fluid passage 27 from the enclosure 30 through the inlet port 22 and expel air out to the enclosure from the fluid passage through the outlet port 24. The flow of air though the housing is indicated in FIG. 1 by dashed arrows 34.

The fluid discharge assembly 14 may be configured to discharge fire suppressing fluid from the flow control assembly 20 into the fluid passage 27 and toward the outlet port 24. At least one of the fluid passage and the fluid discharge assembly may be configured such that the discharge of the fire suppressing fluid into the fluid passage draws air into the fluid passage through the inlet port 22 and around the fire suppressing fluid source 28, and expels air and the fire suppressing fluid out of the fluid passage and through the outlet port.

As air passes through the housing 12 the air may exchange heat or thermal energy with the housing and the other contents of the housing, for example, with the fire suppressing fluid source 28. If the air within the enclosure 30 is increasing in temperature, due to the presence of a fire within the enclosure or outside of the enclosure, then the air drawn in to the housing through the first port 22 may be of a higher temperature than the components of the fire suppression system 10. As this hotter air passes through the housing heat may flow from the hotter air to, for example, the fire suppressing fluid source 28, thereby cooling the air. The cooler air may be discharged out of housing to the enclosure through the outlet port 24. Removing hotter air from the enclosure and replacing it with cooler air may help suppress fire within the enclosure.

In some embodiments, fluid discharge assembly 14 may include at least one wall forming a structure within the fluid passage. The structure may have a structure interior that is fluidly connected to the housing interior 26 on one open end 34 and to the outlet port on another open end 36. The structure may be disposed between the fire suppressing fluid source 28 and the outlet port 24. In some embodiments, the structure may be a hollow cylinder with open opposed ends.

The fluid discharge assembly may include a discharge pipe disposed within the structure interior. The discharge pipe may be configured to discharge or expel a jet or stream of fire suppressing fluid 38 toward the outlet port 24 of the housing. The jet of fire suppressing fluid may originate within the structure within the fluid discharge assembly 14 and proceed out of the housing through the outlet port. The presence of a high speed fluid within the fluid discharge assembly may decrease pressure within the fluid discharge assembly relative to the pressure within the housing interior 26, as described by Bernoulli's principle. This pressure difference may draw air into the fluid discharge assembly from the housing interior through the open end 34 of the fluid discharge assembly. Drawing air from the housing interior into the fluid discharge assembly may in turn draw air into the housing interior through the inlet port 22. The jet of fire suppressing fluid may also expel air out of the housing interior through the fluid discharge assembly and the outlet port.

The stream of fire suppressing fluid expelled by the fluid discharge assembly 14 may cause circulation of air through the fluid passage 27 of the housing 12 and may deliver fire suppressing fluid to the enclosure 30. The flow of air is indicated at 32. Examples of fire suppressing fluids include carbon dioxide (CO2), Halotron® I, Halotron® II, and helium among others. The fire suppressing fluid source 28 may be, for example, one or more tanks of liquid carbon dioxide. In addition to the heat exchange described above, delivering fire suppressing fluid to the enclosure may suppress fire in at least four ways.

First, the relative concentration of oxygen within the enclosure may decrease as hotter air is removed from the enclosure and replaced with a combination of cooler air and the fire suppressing fluid. Fire requires oxygen as a fuel and reducing the relative concentration of oxygen within the enclosure may yield an atmosphere within the enclosure incapable of sustaining combustion.

Second, introducing fire suppressing fluid into the enclosure may increase the atmospheric pressure within the enclosure relative to the external space around the enclosure. This positive pressure difference may prevent superheated gases from entering the enclosure in the case where a fire is located outside of the enclosure.

Third, introducing fire suppressing fluid into the enclosure may decrease the relative humidity within the enclosure, as fire suppressing fluids such as CO2 are generally dry. In the case where a fire is located outside of the enclosure, the temperature within the enclosure may gradually rise to the point where the contents of the enclosure may spontaneously combust. Reducing the relative humidity within the enclosure may slow the transfer of heat to the contents of the enclosure and may prevent the contents from reaching such a high temperature.

Decreasing the relative humidity within the enclosure may have an additional benefit. In some classes of safes, the relative humidity should not exceed 80% during a fire as humidity levels above 80% may cause damage to electronics and documents. Introducing fire suppressing fluid into the enclosure may help protect electronics and/or documents held within the enclosure from damage due to high humidity.

Fourth, activating the system may help create a more even temperature distribution within the enclosure by circulating within the enclosure. In the absence of an air circulation system the temperature within the enclosure may be higher toward the top of the enclosure and lower toward the bottom of the enclosure. Circulating air through the housing of the fire suppression system may help create a more even temperature profile within the enclosure, thus reducing a maximum temperature that contents of the enclosure may be exposed to.

Temperature sensor assembly 16 may include any suitable structure configured to detect a fire. For example, temperature sensor assembly 16 may include a temperature sensor 40 configured to detect an increase in temperature corresponding to the presence of a fire. Temperature sensor 40 may be disposed within the housing 12 of the fire suppression system, may be disposed external to the housing, or may be disposed outside of the enclosure in which the housing is disposed. The temperature sensor may be a temperature-sensitive release mechanism configured to release at a predetermined first temperature. In some embodiments, the temperature-sensitive release mechanism may be a fire sprinkler head having a heat-sensitive glass bulb containing a liquid, such as liquid alcohol. An increase in temperature in the area surrounding the fire sprinkler head may cause thermal expansion of the liquid inside the bulb, which may break the bulb above a predetermined design temperature. In other embodiments, the fire sprinkler head may include a two-part metal link held together with a fusible alloy. In still other embodiments, the sensor assembly may include one or more heat detectors, such as fixed temperature heat detectors and rate-of-rise heat detectors, one or more thermal switches, one or more thermal fuses, etc.

In the embodiments where the temperature-sensitive release mechanism includes a breakable glass bulb, breaking the glass bulb may mechanically release another component of the fire suppression system. For example, releasing the temperature-sensitive release mechanism may activate the flow activation assembly 18.

The temperature sensor assembly 16 may include a secondary sensor assembly 42. The secondary sensor assembly 42 may be configured to activate the flow activation assembly in the event that the temperature-sensitive release mechanism 40 fails to release at the predetermined first temperature. For example, the secondary sensor assembly 42 may include a temperature sensitive switch configured to release the temperature-sensitive release mechanism at a predetermined second temperature higher than the predetermined first temperature. In embodiments where the temperature sensitive release mechanism includes a breakable glass bulb, the temperature sensitive switch may cause a current to flow through a wire at temperatures above the second temperature. The wire may be wrapped around the breakable glass bulb and passing current through the wire may heat the glass bulb until it breaks, thereby releasing the temperature-sensitive release mechanism.

In some embodiments, the thermal switch may function as a primary activation device. That is, the thermal switch may be configured to close and allow a flow of current when a first temperature is detected and thereby release the temperature sensitive release mechanism. Additionally, the glass bulb may be configured to break at a second temperature higher than the first temperature when the puncturing device is not released from the retracted position when the first temperature was detected. That is, the glass bulb may break due to the fluid within the bulb if the thermal switch fails to close and break the bulb via passing current through a wire around the bulb.

Breakable glass bulbs may come in a limited range of temperature settings, while thermal switches may be configured to close at a larger range of temperature settings. Thus, using the thermal switch as a primary activation mechanism and the breakable glass bulb as a secondary activation mechanism may allow fire suppression system 10 to be more versatile.

Activation by the thermal switch may allow for a quicker response time that by the breakable glass bulb. The thermal switch may be disposed external to the housing but inside the enclosure, thereby allowing a direct detection of an increase in temperature within the enclosure. The breakable glass bulb may be disposed within the housing and may be configured to break when an increased temperature within the enclosure has transferred to an increased temperature within the housing, which may take time.

Flow activation assembly 18 may include any suitable structure configured to fluidly connect the fire suppressing fluid source 28 to the fluid discharge assembly 14. The flow activation assembly may make this fluid connection in response to a detected increase in temperature by the sensor assembly 16. The flow activation assembly may include a connector 44 configured to be coupled to the fire suppressing fluid source. For example, the connector may be configured to be coupled to one or more tanks of liquid carbon dioxide. The flow activation assembly may further include a barrier, such as a rupture disk and a puncturing device, such as a drill bit.

Prior to release of the temperature-sensitive release mechanism, the barrier may separate the fire suppressing fluid of the fire suppressing fluid source 28 from other components of the fire suppression system, such as the flow activation assembly 18. The puncturing device may be configured to move between a retracted position, in which the puncturing device is spaced from the barrier, and an extended position in which the puncturing device punctures and extends through the barrier. The puncturing device may be held at the retracted position removed from the rupture disk by a locking member against the urging of a bias element, such as a spring, which may be configured to urge the puncturing device toward the extended position. The puncturing device may be configured to allow the fluid to flow through the punctured barrier when the puncturing device extends through the barrier. For example, the puncturing device may include flutes and/or other passages.

The temperature-sensitive release mechanism may be configured to secure the puncturing device in the retracted position against the urging of the bias element. When the temperature-sensitive release mechanism is released, the locking member may release the puncturing device, thereby allowing the puncturing device to move at the urging of the bias element toward the extended position. As the puncturing device moves the puncturing device may rupture or puncture the barrier. Once the barrier is punctured, the fire suppressing fluid source 28 may be fluidly connected to the fluid discharge assembly 14 and other components of the fire suppression system 10. Once fluidly connected, fire suppressing fluid may flow from the fire suppressing fluid source to the fluid discharge assembly, as indicated by arrows 46 in FIG. 1.

The temperature-sensitive release mechanism may release the puncturing device when a first temperature is detected. The temperature sensitive switch may be configured to release the puncturing device from the retracted position to allow the bias element to urge the puncturing device toward the extended position when (i) a second temperature higher than the first temperature is detected and (ii) the puncturing device is not released from the retracted position when the first temperature is detected.

The flow activation assembly 18 may include an alarm 48 configured to generate an alarm in response to the detected increase in temperature. Alarm 48 may include visual indicators, such as lights and/or auditory indicators (such as a speaker0. The alarm may be disposed within the housing 12, external to the housing but inside the enclosure, or external to the enclosure as is appropriate.

The fire suppression system 10 may optionally include a power source 50 configured to provide power to components of the system as needed. In some examples, the fire suppression system may function entirely mechanically without the need of electrical power. In other examples, the power source may provide power to the flow activation assembly 18 and/or the temperature sensor assembly 16. Alarm 48 and the secondary sensor assembly 42 also may require electrical power to operate.

Flow control assembly 20 may include any suitable structure configured to receive fire suppressing fluid from the flow activation assembly 18 and deliver the fire suppressing fluid at a predetermined flow and/or pressure to the fluid discharge assembly 14. For example, the flow control assembly may be configured to maintain a constant flow of fire suppressing fluid to the fluid discharge assembly when the flow activation assembly connects the fire suppressing fluid source 28 with the flow control assembly. The constant flow of fire suppressing fluid may be maintained for a range of pressures within the fire suppressing fluid source 28. During use, pressure within the fire suppressing fluid source may decrease as fire suppressing fluid is dispensed from the fire suppression system 10 into the enclosure 30. The flow control assembly may automatically adjust in response to this drop and pressure in order to maintain a constant flow of fire suppressing fluid. The adjustments made by the flow control assembly may be mechanical and may be driven by the pressure within the fire suppressing fluid source and one or more springs and/or one or more pistons.

For example, the flow control assembly 20 may mechanically regulate the flow of fire suppressing fluid to the fluid discharge assembly 14 via a poppet valve 52 coupled to a pressure regulating spring 54. The poppet valve 52 may be in contact with fire suppressing fluid at a pressure matching the pressure within the fire suppressing fluid source 28 when the flow activation assembly has fluidly connected the source 28 to the fluid discharge assembly 14. The pressure of the fire suppressing fluid may exert a force on the poppet valve urging the poppet valve toward a closed position. The pressure regulating spring may be disposed so as to exert a force on the poppet valve urging the poppet valve toward a more open position. If the pressure within the source 28 is constant, these opposing forces may be in equilibrium. As the pressure within the source 28 decreases, the closing force exerted on the poppet valve may decrease, thereby allowing the pressure regulating spring to urge the poppet valve to a more open position and thus maintain the flow rate of fire suppressing fluid.

Fluid control assembly 20 may include a discharge pipe 56 having a discharge end 58 disposed proximate the open end 34 of the fluid discharge assembly 14. The discharge end may be configured to direct a stream or jet of fire suppressing fluid toward the open end 36 of the fluid discharge assembly. The stream of fire suppressing fluid within the fluid discharge assembly may cause a decrease in pressure within the fluid discharge assembly relative to the housing interior which may drive the circulation of air through the housing.

Example 2

This example describes an illustrative embodiment of a fire suppression system, see FIGS. 2-5.

Figure 2:
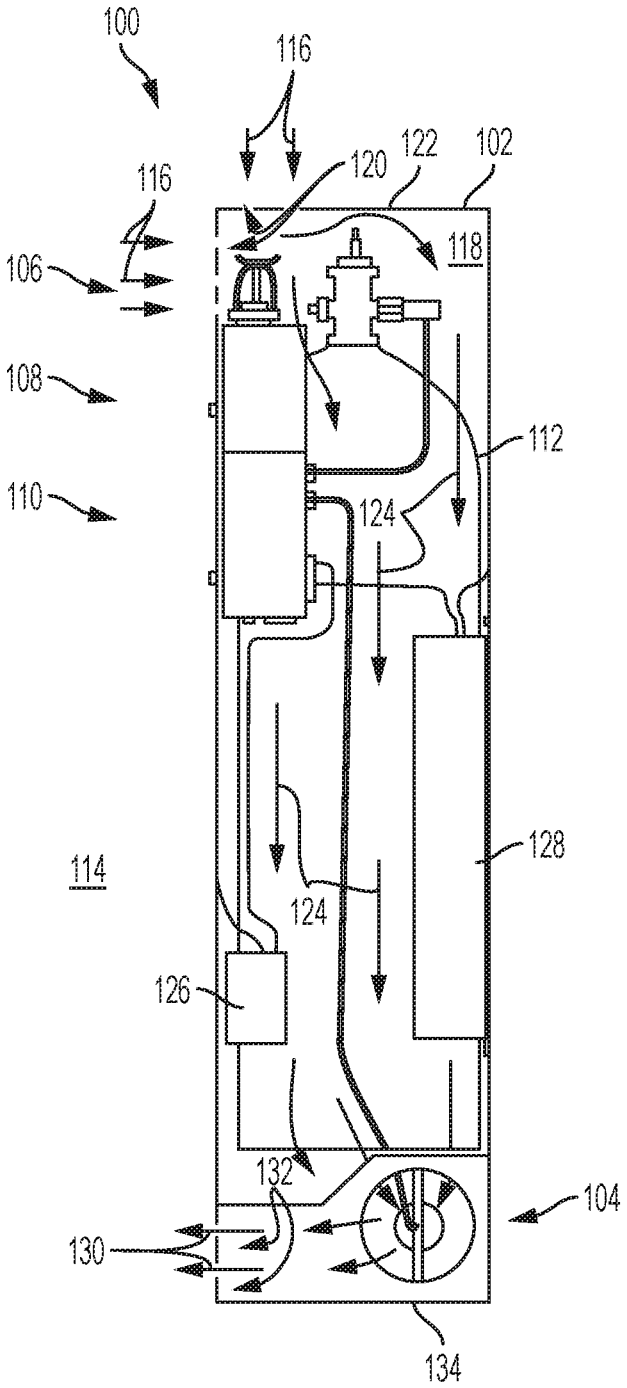
FIG. 2 is a side view of an embodiment of a fire suppression system shown without part of a housing and illustrating airflow through the system.

FIG. 2 shows an example of a fire suppression system, generally indicated at 100. Fire suppression system 100 may be an embodiment of fire suppression system 10 described in Example 1, and the discussion of various features and benefits of system 10 will not be repeated in their entirety. Fire suppression system 100 may include a housing 102, a fluid discharge assembly 104, a temperature sensor assembly 106, a flow activation assembly 108, and a flow control assembly 110.

A fire suppressing fluid source 112 for fire suppression system 100 may be one or more tanks of liquid carbon dioxide. In addition to supplying fire suppressing fluid to an enclosure 114, the tanks 112 may provide a thermal mass capable of absorbing heat from hot air as the air is circulated through the housing and around the tanks. Further, the tanks 112 may experience a drop in temperature as the fire suppressing fluid is delivered from the tanks to the enclosure due to the latent heat required to convert the liquid carbon dioxide into gaseous carbon dioxide. Thus, the tanks ability to absorb thermal energy from the circulating hot air may be continually replenished by dispensing the fire suppressing fluid.

A flow of hotter air into the housing 102 from the enclosure 114 is indicated by arrows 116. The hotter air may flow into a housing interior 118 through an inlet port 120. The inlet port may include a plurality of apertures in the housing or a plurality of gaps between a set of louvers. The inlet port 120 may be disposed proximate a first end 122 of the housing which may be an upper end. A flow of air through the housing interior is indicated by arrows 124. As the air flows though the housing interior, the air may exchange heat with the housing itself, the tanks 112 of liquid CO2, an alarm system 126, a battery pack 128, and/or any of the other components of the fire suppression system 100. A flow of colder air out of the housing into the enclosure is indicated by arrows 130. The colder air may flow out of the housing through an outlet port 132. The outlet port may include a plurality of apertures in the housing or a plurality of gaps between a set of louvers. The outlet port 132 may be disposed proximate a second end 134 of the housing which may be a lower end.

The battery pack 128 may provide a power source for the temperature sensor assembly 106, the flow activation assembly 108, and/or the alarm 126. Alternately, fire suppression system 100 may derive power from a wall socket or other appropriate power source.

Figure 3:
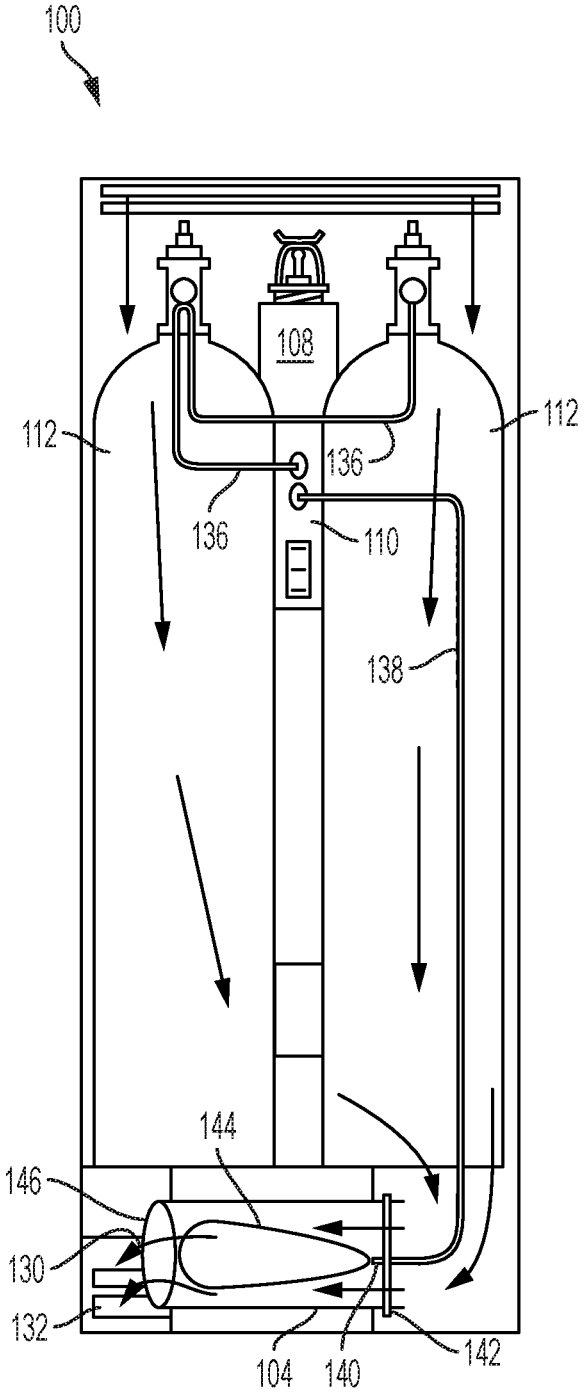
FIG. 3 is a rear view of the fire suppression system of FIG. 2, shown without part of the housing and with an illustrative fluid discharge assembly expelling a fire suppressing fluid.

FIG. 3 shows a rear view of fire suppression system 100. The flow activation assembly 108 may be fluidly connected to the source 112 of fire suppressing fluid by a supply line or pipe 136. The flow control assembly 110 may be fluidly connected to the fluid discharge assembly 104 by a discharge pipe or capillary line 138. The discharge pipe may have a discharge end 140 disposed proximate an open upstream end 142 of the fluid discharge assembly. When the fire suppression system is activated, a stream or jet 144 of fire suppressing fluid may be directed from the discharge end of the capillary line toward an open downstream end 146 of the fluid discharge assembly. The stream 144 of fire suppressing fluid may mix with the flow of colder air 130 within the fluid discharge assembly and may further cool the air circulating through the housing. The mixture of fire suppressing fluid and cooled air may exit the housing through the outlet port 132.

Figure 4:
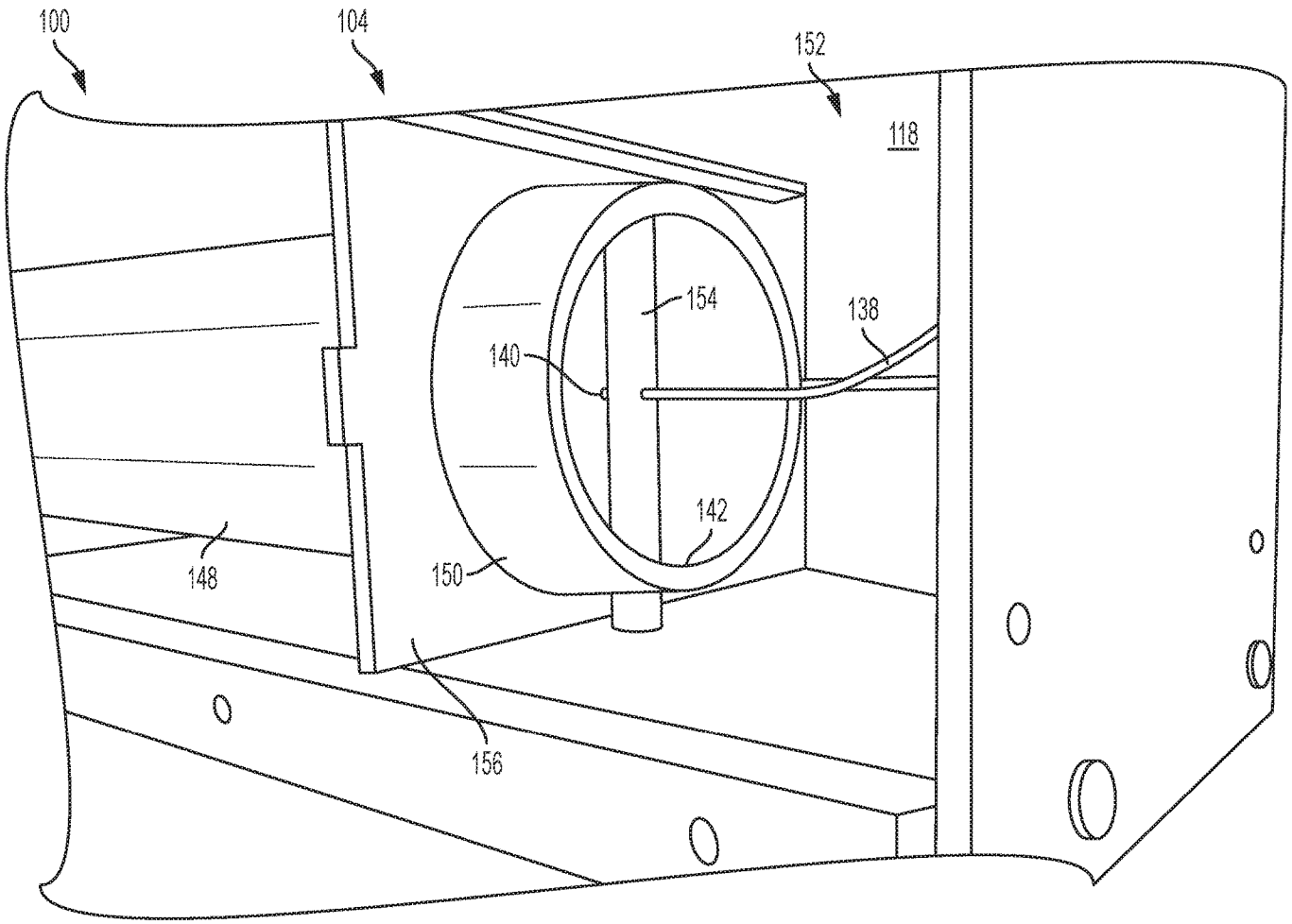
FIG. 4 is a partial perspective view of a fluid discharge assembly of the fire suppression system of FIG. 2.

FIG. 4 is a perspective view of the open upstream end 142 of the fluid discharge assembly 104 of fire suppression system 100. During use, a solid back panel of the housing may prevent such a view of the fluid discharge assembly. The fluid discharge assembly may include at least one wall 148 forming a structure 150 within a fluid passage 152 of the housing interior 118. In the embodiment shown in FIGS. 4-5, structure 150 is a hollow cylinder with open opposed ends 142 and 146. However, many different shapes and configurations are possible for the structure, and the structure need not have a constant shape along its length. The discharge end 140 of the discharge pipe 138 may be held in place proximate the open end 142 of the fluid discharge assembly by a post 154, or any other appropriate member.

Colder air may be drawn into the open end 142 of the fluid discharge assembly 104 by the action of the discharge pipe. Once inside the fluid discharge assembly the colder air may be further cooled by mixing with the fire suppressing fluid and may be accelerated within the fluid discharge assembly toward the outlet port. The mixture of colder air and fire suppressing fluid may be prevented from reentering the housing interior 118 by one or more baffles or barriers 156.

Figure 5:
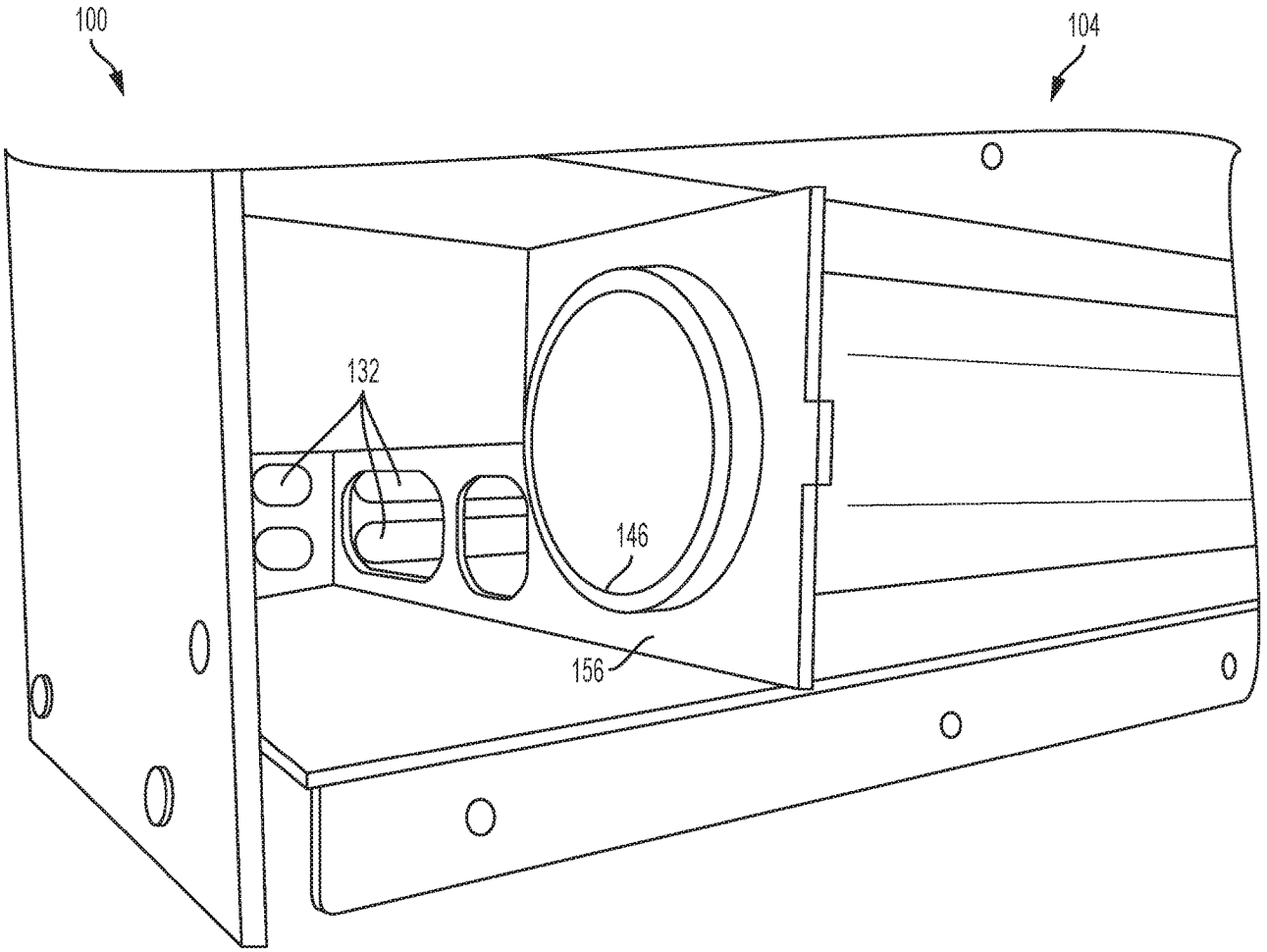
FIG. 5 is another partial perspective view of the fluid discharge assembly of FIG. 4.

FIG. 5 is a perspective view of the open end 146 of the fluid discharge assembly 104 of fire suppression system 100. During use, a solid back panel of the housing may prevent such a view of the fluid discharge assembly. Baffles 156 may prevent the mixture of colder air and fire suppressing fluid from reentering the housing interior, but may allow the mixture to exit the housing through the outlet port 132.

Example 3

Figure 6:
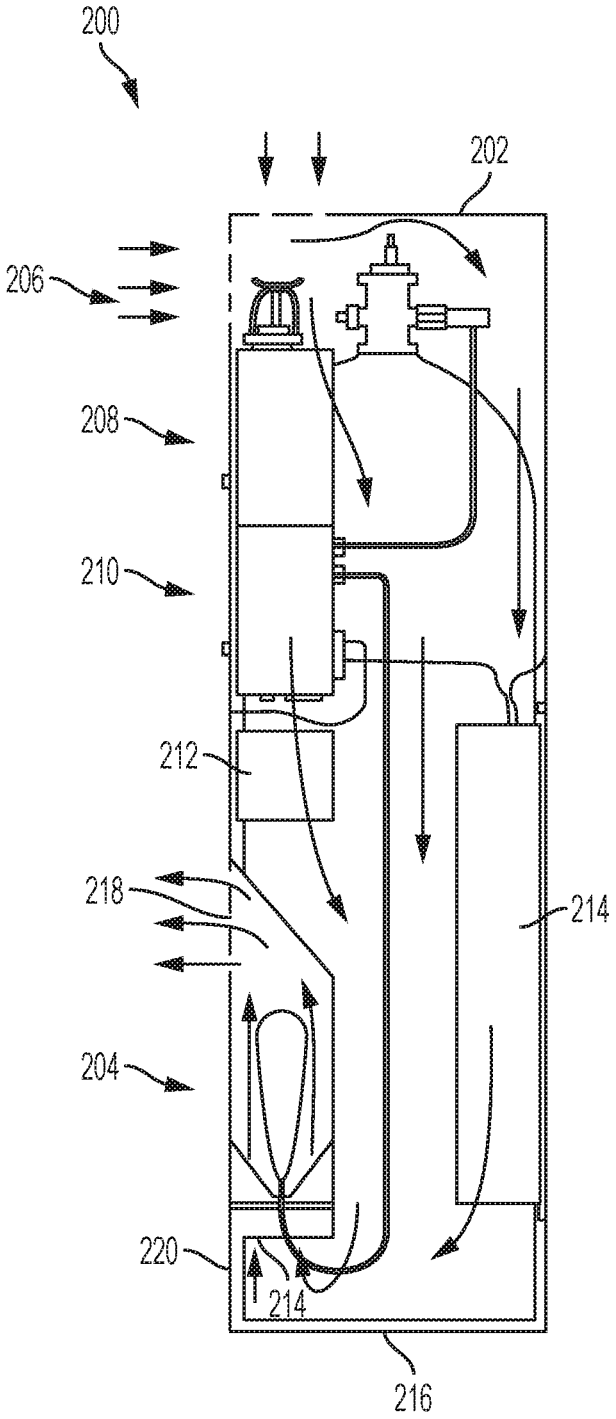
FIG. 6 is a side view of another embodiment of a fire suppression system, shown without part of a housing and with an illustrative a fluid discharge assembly expelling a fire suppressing fluid.
Figure 7:
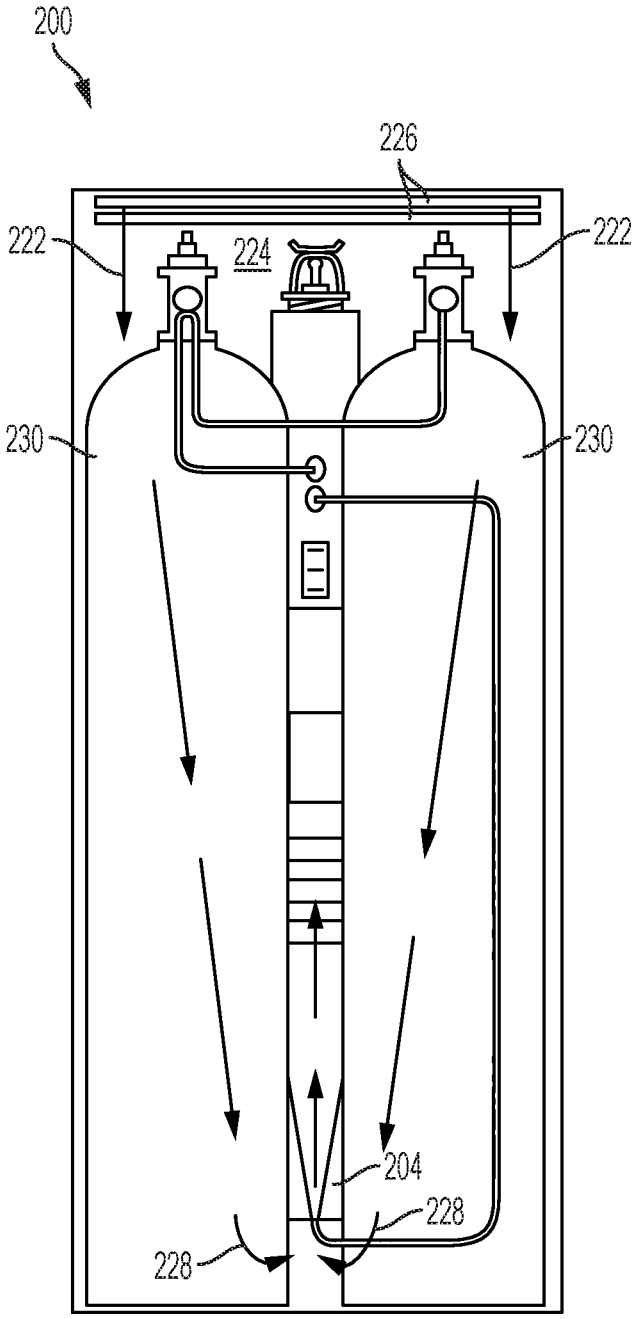
FIG. 7 is a rear view of the fire suppression system of FIG. 6 shown without part of the housing and illustrative airflow through the system.

This example describes an illustrative embodiment of a fire suppression system, see FIGS. 6-7. FIG. 6 shows a side view of a fire suppression system, generally indicated at 200. Fire suppression system 200 may be an embodiment of fire suppression system 10 described in Example 1, and the discussion of various features and benefits of system 10 will not be repeated in their entirety. Fire suppression system 200 may include a housing 202, a fluid discharge assembly 204, a temperature sensor assembly 206, a flow activation assembly 208, and a flow control assembly 210. Fire suppression system 200 may be similar to fire suppression system 100, with the possible exception of the relative disposition of some components of the system, such as an alarm system 212 and a battery pack 214, and an orientation of the fluid discharge assembly 204.

Fluid discharge assembly 204 may be oriented vertically with an open upstream end 214 proximate a bottom end 216 of the housing 202 and an open downstream end 218 spaced from the bottom end of the housing along a front panel 220 of the housing.

FIG. 7 is a rear view of the fire suppression system 200. Hotter air, indicated by arrows 222, may flow into a housing interior 224 through a first port 226 in the housing. As the air flows through the housing the hotter air may exchange heat with the components of the fire suppression system. Colder air, indicated by arrows 228, may be drawn into fluid discharge assembly 204 and propelled out of the housing.

In FIG. 7, a fire suppressing fluid source 230 is indicated as a pair of tanks. Disposing the fluid discharge assembly 204 vertically between the tanks 230, as opposed to below the tanks as is depicted in FIGS. 2-3, may allow for fire suppression system 200 to take up less vertical space than fire suppression system 100 assuming comparable components between the two systems.

Example 4

Figure 8:
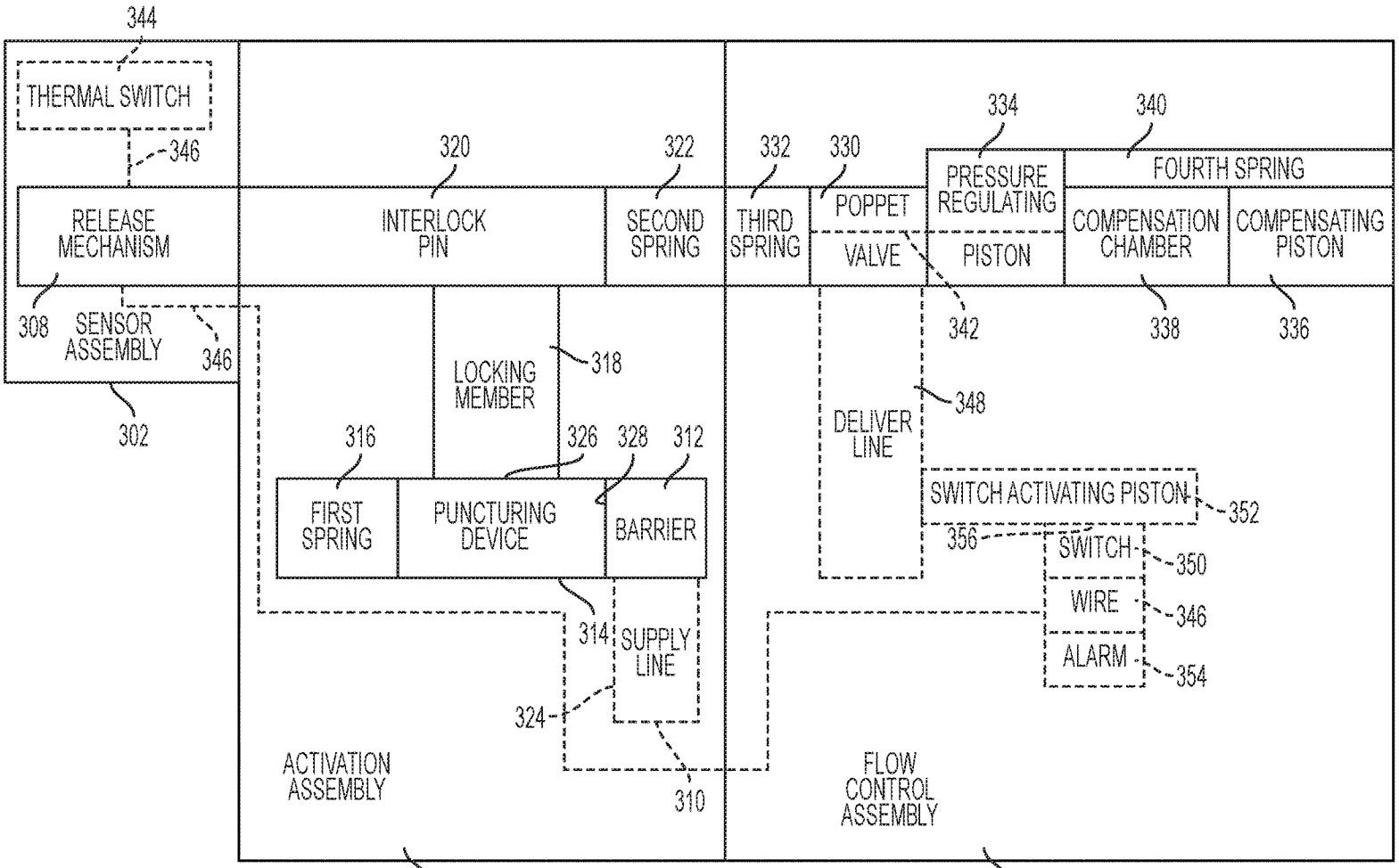
FIG. 8 is a block diagram of another illustrative fire suppression system.

This example describes an illustrative fire suppression system, see FIG. 8.

FIG. 8 is a block diagram of an illustrative fire suppression system, generally indicated at 300. The fire suppression system 300 may be used in conjunction with any of the fire suppression systems described herein, for example fire suppression system 10, fire suppression system 100, and/or fire suppression system 200.

Fire suppression activation and fire suppressing fluid flow control system 300 may include a sensor assembly 302, an activation assembly 304, and a flow control assembly 306. Sensor assembly 302 may be similar to temperature sensor assembly 16 described in Example 1. Activation assembly 304 may be similar to flow activation assembly 18 described in Example 1. Flow control assembly 306 may be similar to flow control assembly 20 described in Example 1. Discussion of various features and benefits of these assemblies will not be repeated in their entirety.

Sensor assembly 302 may include any suitable configured to detect an increase in temperature due to the presence of a fire. For example, sensor assembly 302 may include a temperature-sensitive release mechanism 308. The temperature-sensitive release mechanism may be configured to release one or more components of system 300 at a predetermined first temperature corresponding to the presence of a fire. Alternately, the temperature-sensitive release mechanism may be configured to release one or more components of system 300 in response to a predetermined rate of temperature increase. The temperature-sensitive release mechanism may mechanically release one or more components of system 300.

Activation assembly 304 may include any suitable structure configured to discharge fire suppressing fluid from a fire suppressing fluid source. The activation assembly may be configured to fluidly connect the fire suppressing fluid source to another component of system 300, such as the flow control assembly 306. The activation assembly may include a connector 310, a barrier 312, a puncturing device 314, a first spring 316, a locking member 318, an interlock pin 320, and a second spring 322.

Connector 310 may be configured to be coupled to a fire suppressing fluid source. When the fire suppressing fluid source is coupled to connector 310, fire suppressing fluid may enter the activation assembly 304 through a supply line 324 up to the barrier 312. Barrier 312 may be configured to separate the fire suppressing fluid of the fire suppressing fluid source from the flow control assembly 306. The activation assembly may be configured to break the barrier in response to the detection of an increase in temperature corresponding to the presence of a fire by the sensor assembly 304. Once barrier 312 is breached, fire suppressing fluid may flow through the activation assembly and the flow control assembly 306.

Barrier 312 may serve as a fail-safe mechanism in the following sense. The barrier may be a rupture disk configured to rupture at a specified pressure that is lower than a maximum pressure capable of being supported by the fire suppressing fluid source. For example, in the case where the fire suppressing fluid source is one or more tanks of CO2, these tanks may have a separate release mechanism designed to vent the contents of the tanks at a predetermined maximum pressure, 3000 pounds per square inch (psi) in some cases. If a fire is present and the activation assembly fails to puncture the rupture disk and release the flow of fire suppressing fluid, then the temperature and pressure of the tanks may rise toward the maximum pressure. The rupture disk may be configured to rupture at, for example, 2600 psi, thereby effectively activating the system without releasing the temperature-sensitive release mechanism 308.

The puncturing device 314 may have any suitable structure capable of being configured to move between a proximal position in which the puncturing device is spaced form the barrier and a distal position in which the puncturing device punctures and extends through the barrier. The first spring 316 may be configured to urge the puncturing device toward the distal position. The puncturing device may be secured in the proximal position by locking member 318 against the urging of the first spring 316.

The puncturing device 314 may be a spool-mounted drill bit. That is, the puncturing device may include a spool portion 326 and a drill bit 328 mounted to the spool portion. The spool portion 326 may be configured to be alternately held and released by the locking member 318. The drill bit 328 may be configured to puncture the barrier with a sharp end of the drill bit. The drill bit may have flutes or other passages along the length of the drill bit. These passages may allow fire suppressing fluid to flow past the ruptured barrier even if the puncturing device remains in the distal position extending through the barrier.

Locking member 318 may be configured to move between a locking position in which the puncturing device 314 is secured in the proximate position and an unlocking position in which the puncturing device is released form the proximal position. In the locking position, the puncturing device may be held in place against the urging of the first spring 316 by contact forces exerted on the puncturing device by the locking member. In moving from the locking position to the unlocking position the locking member may move away from the puncturing device.

Interlock pin 320 may be an elongate member having a long axis. The interlock pin may be configured to move back and forth along its long axis between a retracted position and an extended position. The second spring 322 may be configured to urge the interlock pin toward the extended position. Prior to release of the temperature-sensitive release mechanism, the interlock pin may be secured in the retracted position by the temperature-sensitive release mechanism against the urging of the second spring. When the interlock pin is secured in the retracted position, the locking member may be secured in the locking position.

When the temperature-sensitive release mechanism 308 is exposed to a predetermined first temperature corresponding to the presence of a fire, the interlock pin 320 may be released by the temperature-sensitive release mechanism and allowed to move toward the extended position at the urging of the second spring 322. When the interlock pin is in the extended position, the locking member 318 may be allowed to move to the unlocking position, thereby releasing the puncturing device to rupture the barrier.

Flow control assembly 306 may have any suitable structure configured to maintain a constant discharge flow of the fire suppressing fluid. Absent other changes in the system, a rate of flow of a fluid between two points may be proportional to a difference in fluid pressure between those two points. Flow control assembly 306 may maintain a constant discharge flow from the fire suppressing fluid source and through the flow control assembly for a range of pressures within the fire suppressing fluid source. Flow control assembly 306 may include a poppet valve 330, a third spring 332, a pressure regulating piston 334, a pressure compensating piston 336, a compensation chamber 338, and a fourth spring 340.

Poppet valve 330 may have a closed position in which substantially no fire suppressing fluid may flow past the poppet valve and through the flow control assembly. Poppet valve 330 may have a plurality of partially open positions between the closed position and a fully open position. In any of the open positions fire suppressing fluid may flow past the poppet valve and through the flow control assembly. The poppet valve may be configured to move between the closed position and any of the open positions.

The third spring 332 may be configured to urge the poppet valve toward the closed position. The pressure regulating piston 334 may be fixedly coupled to the poppet valve and to the fourth spring 340. The fourth spring may be configured to urge the poppet valve, via the pressure regulating piston, toward one of the open positions.

Pressure compensating piston 336 may be slidably coupled to the pressure regulating piston 334. That is, as the poppet valve 330 moves and the pressure regulating piston moves with the poppet valve, the pressure regulating piston may move relative to the pressure compensating piston. The compensation chamber 338 may be disposed between the pressure regulating piston and the pressure compensating piston.

The compensation chamber may be fluidly connected to a through bore 342 through the pressure regulating piston and the poppet valve. When the activation assembly 304 has fluidly connected the fire suppressing fluid source to the flow control assembly, a pressure of fire suppressing fluid within the compensation chamber may be substantially the same as the pressure of fire suppressing fluid within the fire suppressing fluid source.

Poppet valve 330 may be subject to a variety of forces and may take a position among the plurality of open positions and/or the closed position based on the balance of those forces. The third spring 332 may exert a force on the poppet valve directed toward the closed position. The fire suppressing fluid may exert a force on the poppet valve, due to the pressure of the fluid, which may be directed toward the closed position. The pressure regulating piston 334 may exert one or more forces on the poppet valve directed toward one of the open positions. These forces may arise from the fourth spring 340 and/or the pressure of the fire suppressing fluid within the compensation chamber.

If the pressure within the fire suppressing fluid source drops, perhaps due to a depletion of the fire suppressing fluid, the pressure within the compensation chamber may also drop. Further, if the pressure within the fire suppressing fluid source drops, a force on the poppet valve toward the closed position may decrease in magnitude. In this case the poppet valve may move to an open position or a more open position. That is, the fourth spring 340 and the pressure regulating piston 334 may be configured to move the poppet valve 330 further toward the open position (or fully open position) in response to a drop in pressure in the compensation chamber relative to the poppet valve position prior to the drop in pressure. Moving the poppet valve to a more open position (or further toward the open position or fully open position) may maintain a constant flow of fire suppressing fluid even as the supply of fire suppressing fluid diminishes.

Sensor assembly 302 may further include a thermal switch 344 and a wire 346. The thermal switch may be configured to close at a predetermined second temperature greater than the first temperature. The wire 346 may extend from the flow control assembly 306 to the temperature-sensitive release mechanism 308 and to the thermal switch 344. Wire 346 may be configured to carry current when the thermal switch is closed and to activate the temperature-sensitive release mechanism in the event that the temperature-sensitive release mechanism fails to release the interlock pin 320 at the first predetermined temperature. That is, the temperature sensitive switch may serve as a fail-safe or backup system to the temperature-sensitive release mechanism. This backup system may only activate if the primary system of the temperature-sensitive release mechanism fails to either register the presence of a fire or properly release the interlock pin if the presence of the fire is registered.

In other embodiments, the thermal switch 344 may be configured to release the temperature-sensitive release mechanism at the first temperature. In these embodiments, the temperature-sensitive release mechanism may include a glass bulb configured to break at a second temperature higher than the first temperature in the event that the thermal switch fails to close at the first temperature, such as the thermal switch failing to break the glass bulb at the first temperature.

Fire suppression system 300 may further include a delivery line 348, a microswitch 350, an activating piston 352, and an alarm assembly 354. Microswitch 350 may have an actuator 356. When the activation assembly 304 is not discharging fire suppressing fluid from the fire suppressing fluid source to the flow control assembly, the activating piston may be in a first position in which the activating piston is spaced from the actuator 356 of the microswitch.

When the activation assembly 304 is discharging fire suppressing fluid to the flow control assembly, fire suppressing fluid may flow past the poppet valve 330 and through the delivery line 348. The fire suppressing fluid flowing through the delivery line may exert a force on the activating piston which may move the activating piston to a second position in which the activating piston contacts the actuator to actuate the microswitch. The microswitch may be configured to prevent a flow of electrical current to the thermal switch 344 via the wire 346 when actuated via the actuator.

In the case where the fire suppressing fluid source has been connected to the flow control assembly by the closing of the thermal switch, then once the flow of fire suppressing fluid has been established there may no longer be a need for current to flow to the thermal switch. In the case where the fire suppressing source has been connected to the flow control assembly by the temperature-sensitive release mechanism without the closing of the thermal switch, then once the flow of fire suppressing fluid has been established there may be no need for current to flow to the thermal switch. In both of these cases, the microswitch may prevent the flow of current to the thermal switch once the fire suppression system has been activated.

Alarm assembly 354 may be configured to generate one or more audiovisual outputs. These outputs may indicate that the fire suppression system has been activated and that fire suppressing fluid is flowing from the fire suppressing fluid source to the flow control assembly. The alarm assembly may be activated by the microswitch. That is, the microswitch 352 may not provide current to the alarm assembly when the activating piston 352 is in the first position and may provide current to the alarm assembly when the activating piston is in the second position. The microswitch may activate the alarm system when actuated by the actuator 356.

Microswitch 350 may be coupled to a power source such as a pack of batteries or an electrical outlet. The power source may provide electrical current for operation of the alarm assembly and/or to the sensor assembly 302.

Example 5

Figure 9:
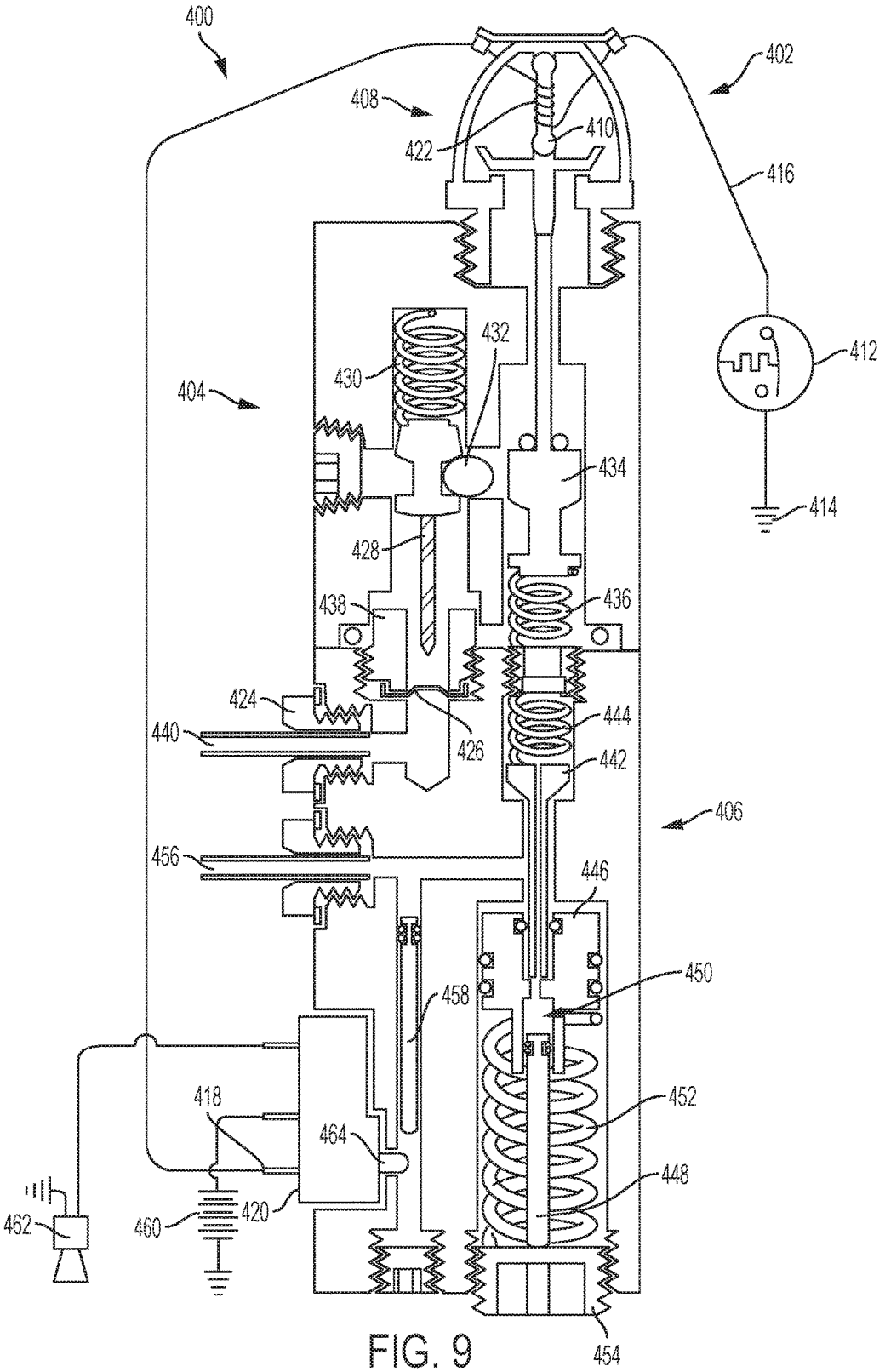
FIG. 9 is a partial sectional view of an embodiment of a fire suppression system.
Figure 10:
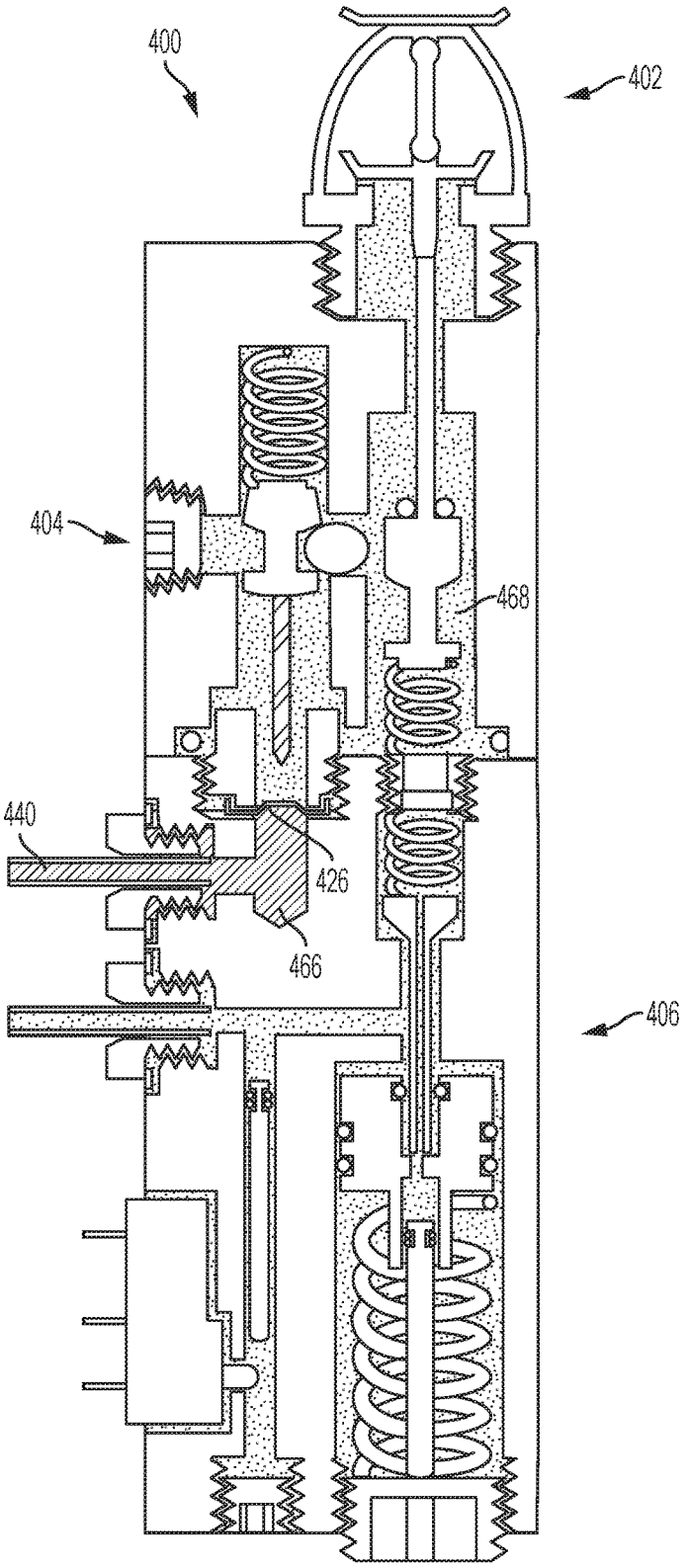
FIG. 10 is the partial sectional view of the system of FIG. 9, showing illustrative pressures in the system when a locking member of an activation assembly of the system is in a locking position.
Figure 11:
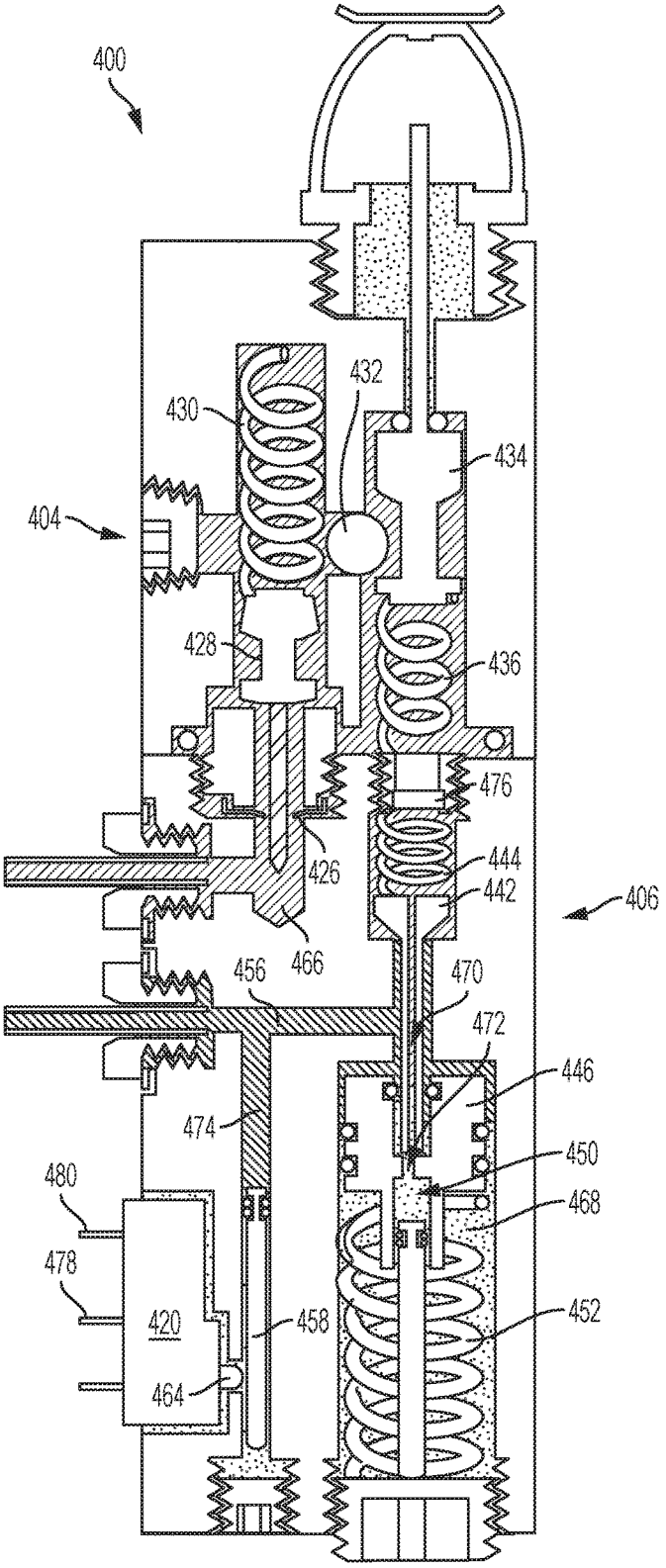
FIG. 11 is the partial sectional view of FIG. 10, showing illustrative pressures in the system when the locking member of the activation assembly of the system is in an unlocking position.

This example describes an illustrative embodiment of a fire suppression system, see FIGS. 9-11.

FIG. 9 is a sectional view of an embodiment of a fire suppression system, generally indicated at 400. Fire suppression system 400 may be an embodiment of fire suppression system 300 described in Example 4, and the discussion of various features and benefits of system 300 will not be repeated in their entirety. Fire suppression system 400 may include a sensor assembly 402, an activation assembly 404, and a flow control assembly 406.

Sensor assembly 402 may include a temperature-sensitive release mechanism 408. The temperature-sensitive release mechanism may be a fire sprinkler head including a breakable glass bulb 410. Bulb 410 may be configured to break at a predetermined first temperature. The fire sprinkler head may not be connected to any water source.

The sensor assembly 402 may include a thermal switch 412. The thermal switch may be configured to be open below a predetermined second temperature lower or higher than the predetermined first temperature. One end of the thermal switch may be connected to an electrical ground 414. The other end of the thermal switch may be connected to a wire 416 coupled to a first pin 418 of a microswitch 420. Wire 416 may include a coiled portion 422 wrapped around the breakable glass bulb 410. Before the fire suppression system has been activated, the first pin 418 may be held at a non-zero voltage. In the event that the switch closes at the predetermined second temperature, current may flow through wire 416, including the coiled portion 422 around the glass bulb. This current may raise the temperature of the glass bulb and cause the bulb to break. As described in Example 4, releasing the temperature-sensitive release mechanism 408 may result in the microswitch 420 preventing the flow of current to the thermal switch. That is, once the glass bulb breaks, the first pin 418 may be held at zero voltage so that current does not flow toward the thermal switch 412.

Activation assembly 404 may include a connector 424, a barrier 426, a puncturing device 428, a first spring 430, a locking member 432, an interlock pin 434, and a second spring 436. Activation assembly 404 is depicted in FIG. 9 in a locked configuration where a fire suppressing fluid source is not fluidly coupled to the flow control assembly 406. In this locked configuration, the barrier 426 is intact, the puncturing device 428 is in a proximal position spaced from the barrier, the first spring 430 is urging the puncturing device toward the barrier and a distal position, the locking member 432 is in a locking position and is securing the puncturing device in the proximal position, the interlock pin 434 is in a retracted position and securing the locking member in the locking position, the second spring 436 is urging the interlock pin toward an extended position, and the interlock pin is secured in the retracted position against the urging of the second spring by the temperature-sensitive release mechanism 408.

Barrier 426 may be a rupture disk which may be held in place by a rupture disk holder 438. In order to reset the fire suppression system 400 after it has been activated, the rupture disk may be replaced with a new, unpunctured barrier. Connector 424 may allow a supply line 440 to deliver fire suppressing fluid to the barrier 426.

Flow control assembly 406 may include a poppet valve 442, a third spring 444, a pressure regulating piston 446, a pressure compensating piston 448, a compensation chamber 450, and a fourth spring 452 as described in Example 4. Third spring 444 may ensure that the poppet valve 442 remains in contact with the pressure regulating piston 446 even when fire suppressing fluid is not flowing through the system. The flow control assembly 406 may further include a set screw 454. Set screw 454 may be coupled to the pressure compensating piston 448 and adjusting the set screw may alter the configuration of the compensation chamber 450. Altering the configuration of the compensation chamber may have an effect on how open the poppet valve is when fire suppressing fluid is flowing through the system. Adjusting the set screw may allow the spring force of fourth spring 452 to be adjusted, thereby allowing a target discharge pressure to be adjusted. Pressure compensating piston 448 may be configured to allow the pressure regulating piston 446 a full range of travel regardless of the position of the set screw 454.

Fire suppression system 400 may further include a delivery line 456, an activating piston 458 at a first position, a power source 460, and an alarm system 462. Microswitch 420 may have an actuator 464.

FIG. 10 is a sectional view of fire suppression system 400, showing pressures in the system when the activation assembly is in a locked configuration. In the locked configuration, fire suppressing fluid may be present in the supply line 440 and the activation assembly up to the barrier 426. This fire suppressing fluid may be at a pressure substantially equal to a tank pressure within the fire suppressing fluid source. Fire suppressing fluid at tank pressure is indicated by diagonal hatching 466. The rest of the activation assembly, the sensor assembly 402, and the flow control assembly 406 may contain air at approximately atmospheric pressure. Air at atmospheric pressure is indicated by the dotted pattern 468.

FIG. 11 is a sectional view of fire suppression system 400, showing pressures in the system when the activation assembly is in an activated configuration. In the activated configuration, the barrier 426 may be punctured, the puncturing device 428 may be in a distal position and extending through the barrier, the locking member 432 may be in an unlocking position, the interlock pin 434 may be in an extended position, and the glass bulb, see 410 in FIG. 9, may be broken and no longer in contact with the interlock pin. Further, fire suppressing fluid at tank pressure 466 may be disposed proximate the puncturing device, the first spring 430, the interlock pin, the second spring 436, the third spring 444, the poppet valve 442, a bore 470 through the poppet valve, a bore 472 through the pressure regulating piston 446, and within compensation chamber 450. Air at atmospheric pressure 468 may be disposed proximate the fourth spring 452 and the microswitch 420. Fire suppressing fluid at a target discharge pressure is indicated by bold diagonal hatching 474. Fire suppressing fluid at the target discharge pressure may be disposed proximate the poppet valve, the delivery line 456, and the activating piston 458.

Fire suppressing fluid at tank pressure 466 proximate the third spring 444 may exert a force on the poppet valve 442 urging the poppet valve toward a closed position. Fire suppressing fluid at target discharge pressure 474 may exert a force on the pressure regulating piston 446, which may be fixedly coupled to the poppet valve, urging the poppet valve toward a closed position. Fire suppressing fluid at tank pressure 466 in the compensation chamber 450 may exert a force on the pressure regulating piston urging the poppet valve toward an open position.

A variety of tank pressures and target discharge pressures are possible and may depend on the type of fire suppressing fluid used and the desired flow rate of fire suppressing fluid among other factors. In some embodiments, tank pressure may be in a range of 700 to 2600 psi. In some embodiments, the target discharge pressure may be in a range of 300 to 600 psi. The discharge flow rate of the fire suppressing fluid past the poppet valve 442 may depend on the difference between the tank pressure and the target discharge pressure and how open the poppet valve is, among other factors. A filter 476 may be disposed upstream of the poppet valve, for example between the second spring 436 and the third spring 444, to prevent debris from entering the poppet valve.

Fire suppressing fluid at the target discharge pressure 474 may move the activating piston from the first position to the second position when the activation assembly 404 connects the fire suppressing fluid source to the flow control assembly 406. In moving to the second position, the activating piston may actuate the microswitch 420 via the actuator 464. Microswitch 420 may receive a non-zero voltage from power source 460 via a second pin 478, see FIG. 9. When activated, microswitch 420 may deliver the non-zero voltage to a third pin 480 which may be coupled to the alarm assembly 462, see FIG. 9.

Example 6

Figure 12:
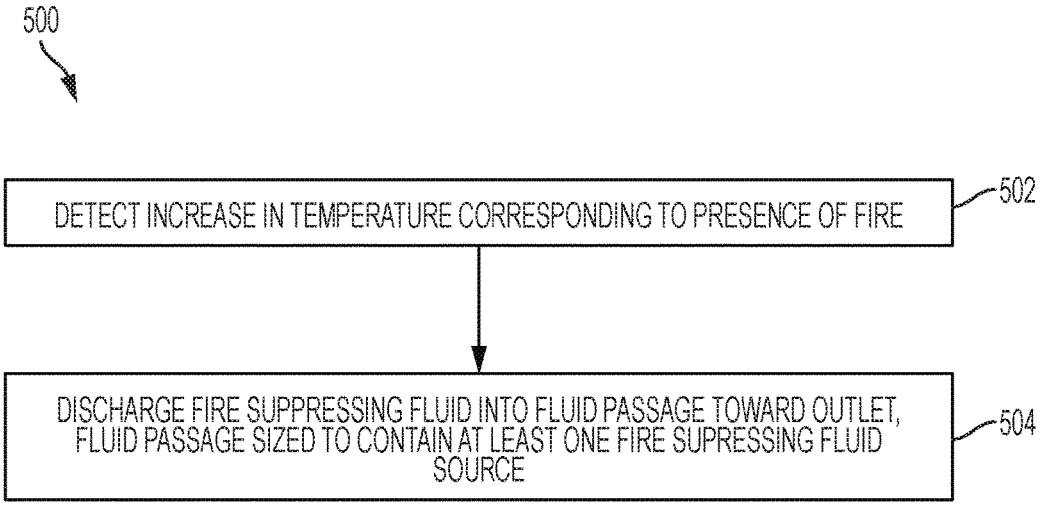
FIG. 12 is a flow chart depicting an illustrative method of suppressing a fire in an enclosure.

This example describes an illustrative method of suppressing a fire in an enclosure, which may be used in conjunction with any of the apparatuses or systems described herein; see FIG. 12.

FIG. 12 depicts multiple steps of a method, generally indicated at 500 of suppressing a fire in an enclosure. Method 500 may be used in conjunction with any of the fire suppression systems depicted and described in reference to FIGS. 1-11. Although various steps of method 500 are described below and depicted in FIG. 12, the steps need not necessarily all be performed, and in some cases may be performed in a different order than the order shown.

Method 500 may include a step 502 of detecting an increase in temperature corresponding to the presence of a fire. The increase in temperature may be detected by an electrical device, a mechanical device, or a combination electrical mechanical device. For example, a breakable glass bulb as described previously may break or shatter at a predetermined elevated temperature. In another example, a temperature sensitive switch may close at a predetermined elevated temperate, thereby causing a flow of current signaling the presence of a fire. The flow of current could be directed to a processor or may be used to break a breakable glass bulb.

Method 500 may include a step 504 of discharging fire suppressing fluid into a fluid passage towards an outlet, wherein the fluid passage is sized to contain at least one fire suppressing fluid source. Discharging the fire suppressing fluid may draw air from the enclosure into the fluid passage and around the fire suppressing fluid source and expel air and fire suppressing fluid out of the fluid passage through the outlet and toward the enclosure. The fire suppressing fluid may be discharged from the at least one fire suppressing fluid source toward the outlet of the fluid passage in response to a detected increase in temperature. The air may be drawn into the fluid passage through an inlet of the fluid passage.

For example, in the fire suppression system 100 described in Example 2, the fluid passage may extend from an inlet, namely inlet port 120, through the housing interior 118, through the fluid discharge assembly 104, through structure 150, to an outlet of the outlet port 132. In this example the fire suppressing fluid may be discharged in the structure 150 of the fluid passage toward the outlet port 132. The housing interior 118 of the fluid passage may be sized to contain at least one fire suppressing fluid source in the form of two tanks 112 of liquid CO2.

Discharging fire suppressing fluid may include mechanically regulating a flow of the fire suppressing fluid to maintain a constant flow of fire suppressing fluid discharged into the fluid passage. Mechanically regulating the flow of fire suppressing fluid may include regulating the flow of fire suppressing fluid via a poppet valve that is urged by a pressure regulating spring.

For example, in the fire suppression system 400 described in Example 5, at least one of the poppet valve 442, the pressure regulating piston 446, the pressure compensation piston 448, and the fourth spring 452 may be configured to mechanically regulate the flow of fire suppressing fluid so as to maintain a constant flow of fire suppressing fluid. This constant flow may be maintained for a range of pressures within the fire suppressing fluid source.

Discharging the fire suppressing fluid may optionally include mechanically connecting the fire suppressing fluid source to a flow control assembly disposed between the fire suppressing fluid source and the enclosure. For example, mechanically connecting the fire suppressing fluid source to a flow control assembly may include puncturing a barrier with a puncturing device to establish a fluid connection.

Advantages, Features, Benefits

The different embodiments of the fire suppression systems described herein provide several advantages over known solutions for suppressing or preventing a fire within an enclosure. For example, the illustrative embodiments of the fire suppression systems described herein allow for heat to be actively removed from the enclosure. Additionally, and among other benefits, illustrative embodiments of the fire suppression systems described herein allow a controlled release of fire suppressing fluid to the enclosure. Thus, the illustrative embodiments described herein are particularly useful for suppressing fire within an enclosure such as a safe or cabinet. However, not all embodiments described herein provide the same advantages or the same degree of advantage.

Conclusion

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

I claim:

1. A fire suppression system, comprising:

a housing including an inlet port, an outlet port, and a housing interior having a fluid passage, the fluid passage is sized to contain a fire suppressing fluid source between the inlet and outlet ports, the inlet and outlet ports are fluidly connected to the fluid passage;

a temperature sensor assembly configured to detect an increase in temperature corresponding to presence of a fire;

a connector configured to be coupled to the fire suppressing fluid source;

a flow control assembly, wherein the connector is configured to fluidly connect the fire suppressing fluid source with the flow control assembly in response to a detected increase in temperature by the temperature sensor assembly, and the flow control assembly is configured to maintain a constant flow of fire suppressing fluid when the connector fluidly connects the fire suppressing fluid source with the flow control assembly; and a fluid discharge assembly configured to discharge the fire suppressing fluid from the flow control assembly into the fluid passage and toward the outlet port, the fluid discharge assembly includes at least one wall forming a structure within the fluid passage, the formed structure includes a structure interior that is fluidly connected to the housing interior, the formed structure further includes first and second open ends, the first open end is fluidly connected to the housing interior and the second open end is fluidly connected to the outlet port, the fluid discharge assembly further includes a discharge pipe disposed within the structure interior, the discharge pipe is configured to discharge the fire suppressing fluid into the structure interior and toward the outlet port, wherein the fluid discharge assembly is configured such that the discharge of the fire suppressing fluid by the discharge pipe into the structure interior (i) draws air into the fluid passage through the inlet port, around the fire suppressing fluid source, and into the first open end and (ii) expels air and the discharged fire suppressing fluid out of the second open end and the fluid passage and through the outlet port.

2. The fire suppression system of claim 1, wherein the structure is a hollow cylinder with the first and second open ends.

3. The fire suppression system of claim 1, wherein the flow control assembly includes a poppet valve and a pressure regulating spring, wherein the poppet valve is configured to regulate the flow of the fire suppressing fluid, and the pressure regulating spring is configured to urge the poppet valve in a position that maintains a constant flow of fire suppressing fluid exiting the flow control assembly.

4. The fire suppression system of claim 1, wherein the connector is configured to be coupled to one or more tanks of liquid carbon dioxide.

5. The fire suppression system of claim 1, further comprising a power source configured to provide power to at least the temperature sensor assembly.

6. The fire suppression system of claim 1, further comprising:

a barrier separating the fire suppressing fluid of the fire suppressing fluid source and the fluid activation assembly;

a puncturing device configured to move between a retracted position in which the puncturing device is spaced from the barrier, and an extended position in which the puncturing device punctures and extends through the barrier; and a bias element configured to urge the puncturing device toward the extended position.

7. The fire suppression system of claim 6, wherein the temperature sensor assembly includes a temperature-sensitive release mechanism configured to secure the puncturing device in the retracted position against the urging of the bias element and to release the puncturing device from the retracted position to allow the bias element to urge the puncturing device toward the extended position when a first temperature is detected.

8. The fire suppression system of claim 7, wherein the temperature sensor assembly includes a temperature sensitive switch configured to release the puncturing device from the retracted position to allow the bias element to urge the puncturing device toward the extended position when a second temperature different from the first temperature is detected.

9. The fire suppression system of claim 8, wherein the second temperature is lower than the first temperature, and the temperature-sensitive release mechanism is configured to release the puncturing device from the retracted position to allow the bias element to urge the puncturing device toward the extended position when (i) the first temperature is detected and (ii) the puncturing device was not released from the retracted position in response to the second temperature being detected.

10. The fire suppression system of claim 8, wherein the second temperature is higher than the first temperature, and the temperature sensitive switch is configured to release the puncturing device from the retracted position to allow the bias element to urge the puncturing device toward the extended position when (i) the second temperature is detected and (ii) the puncturing device was not released from the retracted position in response to the first temperature being detected.

* * * * *